United States Patent [19]

Goodridge et al.

[11] Patent Number: 4,670,116

[45] Date of Patent: Jun. 2, 1987

[54] PURIFYING MIXED-CATION ELECTROLYTE

[75] Inventors: Francis Goodridge, Ponteland; Raymond E. Plimley, Jesmond; Robert P. Leetham, Broadway, all of England

[73] Assignee: National Research Development Corporation, London, England

[21] Appl. No.: 844,153

[22] Filed: Mar. 26, 1986

[30] Foreign Application Priority Data

Apr. 3, 1985 [GB] United Kingdom ..... 8508726

[51] Int. Cl.[4] ..... C25F 5/00

[52] U.S. Cl. ..... 204/130; 204/222

[58] Field of Search ..... 204/222, 130, 149, 40

[56] References Cited

U.S. PATENT DOCUMENTS

| | | | |
|---|---|---|---|
| Re. 28,379 | 3/1975 | Backhurst et al. | 204/20 |
| 556,092 | 3/1896 | Frolich | 204/111 |
| 3,941,669 | 3/1976 | Bharucha et al. | 204/105 R |
| 3,956,086 | 5/1976 | Wilkinson et al. | 204/105 R |
| 3,969,201 | 7/1976 | Oloman et al. | 204/222 |
| 3,974,049 | 8/1976 | James et al. | 204/106 |
| 3,977,951 | 8/1976 | Lopez-Caciedo | 204/222 |
| 3,988,221 | 10/1976 | Garrett et al. | 204/222 |
| 4,032,425 | 6/1977 | Kametani | 204/222 |
| 4,035,278 | 7/1977 | Wilkinson et al. | 204/222 |
| 4,171,249 | 10/1979 | Newton et al. | 204/222 |
| 4,202,752 | 5/1980 | Sherwood et al. | 204/222 |
| 4,212,722 | 7/1980 | Avedesian et al. | 204/222 |
| 4,240,886 | 12/1980 | Hodges et al. | 204/112 |
| 4,272,333 | 6/1981 | Scott et al. | 204/23 |

FOREIGN PATENT DOCUMENTS

| | | | |
|---|---|---|---|
| 0028158 | 3/1975 | European Pat. Off. | 204/130 |
| 1956457C2 | 6/1985 | Fed. Rep. of Germany | 204/222 |
| 2048306A | 5/1972 | United Kingdom | 204/222 |
| 1194181 | 7/1980 | United Kingdom | 204/222 |
| 1239983 | 8/1980 | United Kingdom | 204/222 |
| 1301202 | 2/1982 | United Kingdom | 204/222 |
| 1304527 | 3/1982 | United Kingdom | 204/222 |
| 575001 | 6/1982 | United Kingdom | 204/222 |
| 1427267 | 7/1983 | United Kingdom | 204/222 |
| 1427268 | 7/1983 | United Kingdom | 204/222 |
| 2144770A | 2/1984 | United Kingdom | 204/222 |

OTHER PUBLICATIONS

"The Galvanic Series" p. 20, Hanson Van-Winkel Munning Co., 1957.

*Primary Examiner*—R. L. Andrews

*Attorney, Agent, or Firm*—Murray and Whisenhunt

[57] ABSTRACT

An electrolyte containing 65 g/l zinc and 150 g/l Cu is purified in zinc, that is, the copper is removed, by causing the electrolyte to fluidize a bed 8 of ½ mm copper particles. The bed is fluidized by 25% to make it 42 cm deep. An anode 11 is disposed above the top of the bed. A cathode 9 is disposed part-way up the bed. Copper is electroplated onto the bed particles. Any zinc which may be electroplated onto the bed particles tends to redissolve with concomitant cementation, on the particles, of copper, which can be recovered. The electrolyte is thus eventually completely stripped of copper and can be used for zinc electrowinning.

By controlling the pH of the electrolyte, substantially one metal, or one desired combination of metals, may be removed. In particular, pure copper deposition can be completed at low pH even in the presence of cadmium; upon a substantial increase in pH, cadmium deposition will occur.

18 Claims, 3 Drawing Figures

PURIFYING MIXED-CATION ELECTROLYTE

This invention relates to a method of purifying a mixed-cation electrolyte, and to apparatus for performing the method. An example of a mixed-cation electrolyte is a nickel electrolyte contaminated with copper, and another example is a feed liquor for zinc electrodeposition, containing as contaminants copper and possibly cobalt and cadmium.

Before zinc is recovered electrochemically, a feed liquor is required where the concentration of copper (and any other cations which would be deposited at an electrode potential lower than that for zinc) has been reduced to less than 1 mg/l (1 part per million).

At present this is done by throwing zinc metal—the very product which is being sought—in the form of finely divided powder into the feed liquor, to precipitate out ('cement') the said cations such as copper. This is severely disadvantageous, if only because production and storage of the zinc powder are expensive, plant for this stage adds to the capital cost, and the consequent liquid/powder separations are cumbersome.

The present invention is a method of purifying an electrolyte containing cations of a less noble metal from contamination by cations of a more noble metal, comprising upwardly levitating (e.g. spouting or fluidising) a bed of (at least superficially) electronically conductive particles with the electrolyte, the particles being more noble than said less noble metal, a cathode current feeder being provided in contact with, and at least halfway (preferably at least three-quarters of the way) up the bed, an anode being provided either (i) in the fluidising electrolyte but at a height above the bed of particles when fluidised or (ii) in contact with the bed but being of a material having a contact resistance in air between itself and a copper test surface of at least 10 times the contact resistance under the same conditions of measurement between the copper test surface and another surface of copper, and applying a voltage between the cathode current feeder and the anode, the electric field being parallel to the levitation, whereby the cations tend to be electroplated on the particles of the bed but the less noble metal (if electroplated) tends to redissolve with concomitant cementation, on the particles, of the more noble metal, controlling the pH of the electrolyte so that substantially one metal, or one desired combination of metals, at a time is removed from it, and removing the electrolyte which has passed through the bed and in which the concentration of the nobler-metal cations has thereby been reduced, or optionally recycling the (or part of the) electrolyte to the bed one or more times before removing it (or part of it), and optionally repeating the method in the same or a different bed or on different particles, at a different pH, to remove a different one or combination of metals.

It will be appreciated that 'purification' in this specification thus means removal of the cations of the *more* noble metal, this metal being regarded as the impurity. If the 'impurity' is of value (perhaps even of more value than the metal being 'purified'), it can be recovered from the bed, for example by removal (on an occasional or continuous basis) of the bed particles which have grown largest, or by exploiting the feature (which sometimes occurs) that the impurity deposit may be only loosely bound to the bed particles and hence tends to be knocked off in the normal jostling motion of the particles; the impurity may thus be recovered, as it becomes detached from the particles and entrained in electrolyte, by filtration of electrolyte which has been through the bed. In such a case, the bed particles could be of a different metal (e.g. cobalt) from the expected impurity (e.g. copper). Where the electrolyte contains cations of three or more metals, the more noble metal(s) behave as 'impurities' in the method, and the less noble metal(s) are 'purified'. The electrolyte in such a case is generally depleted in the order: most noble first. Without pH control, however, this order may be blurred, depending on the closeness of the deposition electrode potentials (which are dependent on the nature of the respective ionic species, its concentration and its temperature). This pH control may be electrolytic, such as by cathodic discharge of hydrogen, or by adding acid (such as $H_2SO_4$) or alkali (such as zinc oxide/hydroxide) as necessary. Ultimately, after a sufficient number of recirculations of the electrolyte and/or with the passage of sufficient current, all cations noble enough to deposit on the bed particles will be removed from the electrolyte and, taking the example of a zinc electrolyte, all those cations will be removed which would otherwise have interfered with the electrodeposition of the zinc.

Taking as examples copper and cadmium cations, the tendency is for copper to be deposited first, and this may be encouraged to the substantial exclusion of cadmium by keeping the pH below 4, preferably below $3\frac{1}{2}$, more preferably below 3, most preferably below $2\frac{1}{2}$. When all the copper ion has been removed from the electrolyte, the pH may be caused or allowed to rise.

Preferably the bed is fluidised to an expansion of up to 70% (e.g. 5 to 50%) of its static (i.e. unlevitated) height, more preferably 15 to 30%.

Preferably the applied voltage (in volts) divided by the distance (in cm) between the cathode current feeder and the top of the bed when levitated is from 1 to 10.

Preferably the current through the bed is from 300A to 3000A per square meter (in plan view) of the bed.

Preferably the electrolyte to be purified contains zinc, copper and optionally cadmium and/or cobalt ions.

Preferably the bed particles are of copper. They are preferably from 0.1 to 1.0 mm in diameter, more preferably from 0.4 to 0.8 mm.

The bed may rest on a distributor for producing a substantially uniform upwards fluidising flow, or may rest on distributor so arranged, possibly in conjunction with the configuration of the bed, to encourage spouting.

The cathode current feeder is part-way up the levitated bed, for example at least five-sixths of the way up, and may be even near the top of the levitated bed, e.g. up to as near as 10 or 30 particle diameters below the top of the levitated bed with the bed operating at an expansion of 20%.

If it appears that the redissolution/cementation aspect of the bed operates more effectively at a different expansion from the most effective expansion for electrodeposition, the bed may be run with differential expansions. Thus, for example, the lower part of the bed may be a narrow column, widening out upwardly in the region of the cathode current feeder, whereby, at a given electrolyte throughput, the lower (redissolution/cementation) part is at a greater expansion than the upper part (electrodeposition, but of course also with the redissolution/cementation occurring alongside);

alternatively, the lower part could be less expanded than the upper part.

The present invention extends to the thus-purified electrolyte and to the thus-grown bed particles.

BRIEF DESCRIPTION OF THE DRAWINGS

The invention will now be described by way of exmaple, with reference to the accompanying drawings, in which.

DETAILED DESCRIPTION OF THE INVENTION

Figure 1:
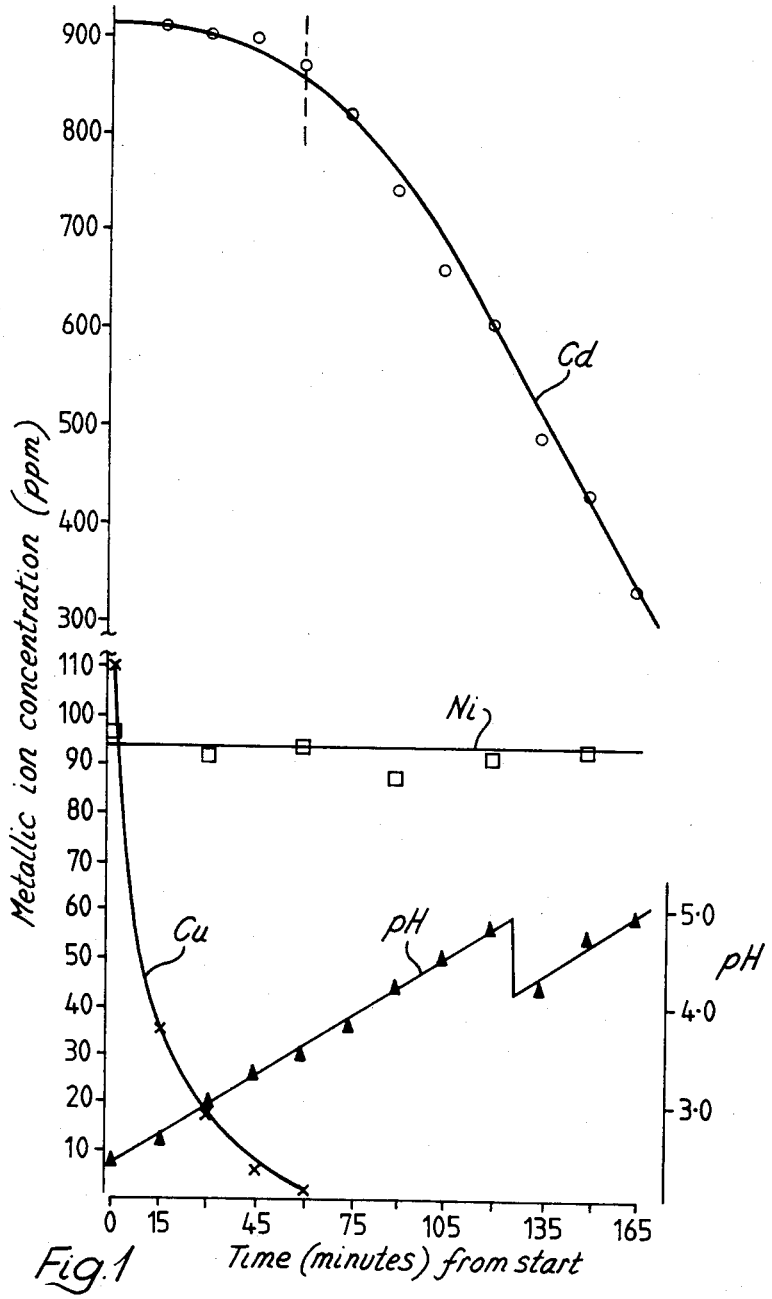
FIG. 1 shows results from Experiment 1.

A cylindrical column of non-conductive material is about 5 cm in diameter (20 $cm^2$ area in plan view) and somewhat over 0.5 m tall. It has a liquid inlet 1 at the base, fed by an adjustable pump 3, and a liquid outlet 5 at the top. Near the base, a flow distributor 7 (such as a sieve or frit) is provided. Mounted 42 cm above the distribtor 7 is a cathode current feeder 9, which is a copper wire bent into one turn of coil. Resting on the distributor 7 is a bed 8 of fairly uniform copper particles (size range 0.5 to 0.7 mm diameter), some 38½ cm deep while at rest.

An anode 11 is provided 52 cm above the distributor 7 and consists of a platinum wire bent into one turn of coil. Alternatively, the anode 11 may be a platinum gauze within an open-ended glass tube provided to minimise the amount of oxygen (evolved at the gauze) which dissolves in the electrolyte, whereby to restrict oxidation (and hence passivation) of the copper particles.

In use, the whole apparatus is filled with an electrolyte 2 from a supply feeding the pump 3, the electrolyte being an aqueous solution of a mixture of zinc, copper, cadmium and nickel sulphates. The pump 3 is adjusted to a flow rate which fluidises the bed 8 by 30%, i.e. to a height of 50 cm above the distributor 7. The top edge 8*a* of the bed remains very well defined, and, though it undulates, never touches the anode 11.

EXPERIMENTS 1 and 2

Figure 3:
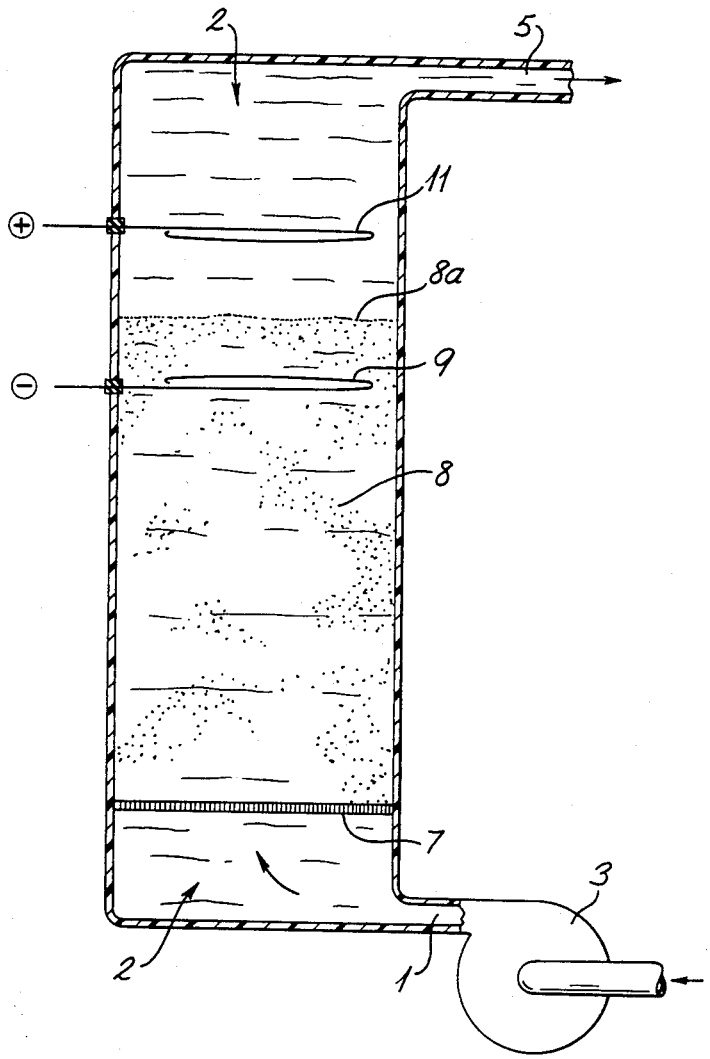
FIG. 3 shows schematically an apparatus according to the invention for performing the method of the invention.

Two experiments were performed, each on a continuously recirculated batch of 10 liters of the electrolyte. In Experiment 1, according to the invention, the bed just described and illustrated in FIG. 3 was charged with an electrolyte, held at 40° C. and containing 900 parts per million by weight cadmium, 90 p.p.m. nickel, some zinc and 110 p.p.m copper, all as the sulphates. A voltage of about 5½ V was applied, adjusted to keep the current density (measured in any horizontal plane between the electrodes) at 1000 $A/m^2$. Instead of the platinum anode, a zinc anode was used, dissolution of which tended to cause the pH to rise throughout the Experiment. In industrial practice, an inert anode would be used.

PH was controlled in a minimal way by adding sulphuric acid until, by a fall in current, it was known that all the copper had deposited. As the pH approached 3½, cadmium started to be removed, all as shown in FIG. 1; the experiment was terminated at 300 p.p.m. cadmium. There was no net deposition of either nickel or zinc. Because the pH control was so restrained, there was some overlap between the last of the copper deposition and the first of the cadmium deposition. This could even be exploited if desired; at a pH controlled to about 4½, copper and cadmium would probably be deposited together.

During cadmium deposition, bed particles tend to agglomerate, which can be counteracted by increasing the bed expansion.

Nitrogen was continuously bled in at the pump, so that no dissolved oxygen would be present in the electrolyte to interfere with the results.

Figure 2:
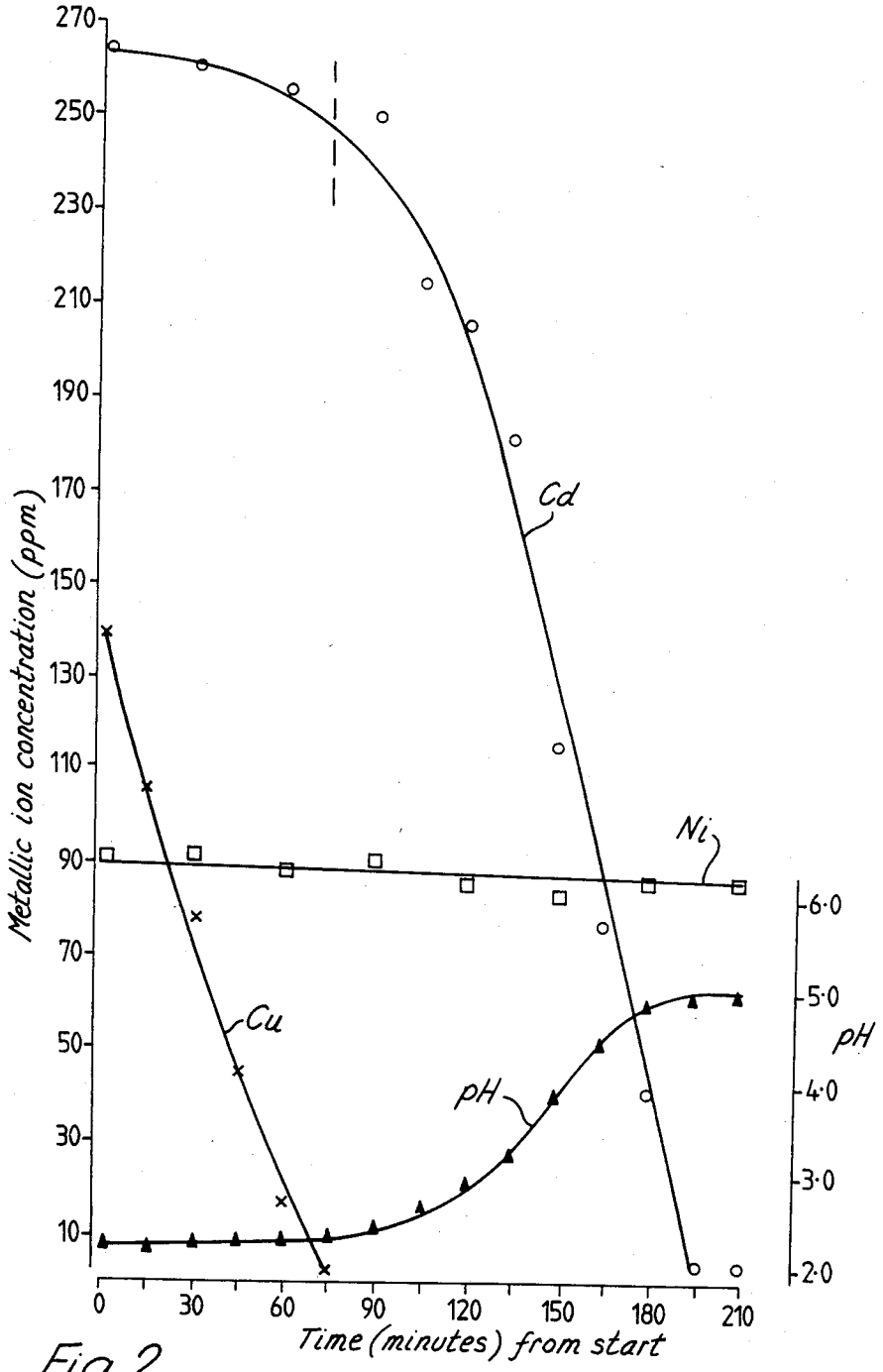
FIG. 2 shows results from Experiment 2.

In Experiment 2, according to the invention, the bed described above and illustrated in FIG. 3 was charged with an electrolyte, held at 40° C. and containing 265 p.p.m. cadmium, 140 p.p.m. copper, some zinc and 90 p.p.m. nickel, all as the sulphates. Again, a zinc anode happened to be used. A voltage of about 6½ V was applied, adjusted to keep the current density at 1000 $A/m^2$. All other operational details were as in Experiment 1, unless otherwise stated.

pH was held down to the levels shown in FIG. 2 by continuous addition of sulphuric acid. When all the copper had been removed, the pH was allowed to rise (by dissolution of the zinc anode), at which the cadmium began to deposit, only negligible (about 10 p.p.m.) cadmium deposition having occurred up to that point. In industrial practice, pH would be increased if felt necessary by adding alkali such as zinc oxide/hydroxide or indirectly by adding elemental zinc.

By measuring the total current passed at 15-minute intervals throughout both Experiments, the current efficiencies of metal deposition were found to be as follows:

| | Copper | Cadmium |
|---|---|---|
| Experiment 1 | 62% (1.1 g deposited) | 68.3% |
| Experiment 2 | 50% | 30% |

EXPERIMENT 3

In Experiment 3, cobalt was removed from a 1M zinc sulphate solution containing nickel and 340 p.p.m. cobalt held at 71° C. on a bed of 1 mm cobalt (or cobalt-plated copper) particles. Unless otherwise stated, the conditions were as described with reference to Experiments 1 and 2.

PH was held within the range 4.8 to 5.3. Cobalt was reduced to 95 p.p.m. at an overall current efficiency of 58%. As in Experiments 1 and 2, there was no net deposition of either nickel or zinc.

The settled bed height was 33 cm over the distributor 7, run at 30% expansion, i.e. to a fluidised depth of 42 cm over the distributor. The feeder position was 21 cm over the distributor.

Temperature being a known control parameter, it is likely that at 90° C. ; greater reduction in cobalt will be possible. With cobalt, copper and cadmium removed, nickel could then be removed by conventional chemical methods.

We claim:

1. A method of purifying an electrolyte containing cations of a less noble metal from contamination by cations of a more noble metal, said method comprising the steps of:

upwardly levitating a bed of at least superficially electronically conductive particles with said electrolyte, said particles being more noble than said less noble metal, a cathode current feeder being provided in contact with and at least halfway up said bed, an anode being provided in said electrolyte but at a height above said bed particles when levitated;

applying a voltage between said cathode current feeder and said anode, the electric field being parallel to the levitation, to cause said cations to be electroplated on the particles of said bed, said less noble metal upon being electroplated redissolving with concomitant cementation of said more noble metal on said particles;

controlling the pH of the electrolyte so that substantially one metal, or one desired combination of metals, at a time is removed from it;

removing electrolyte wich has passed through said bed and in which the concentration of the nobler metal cations has thereby been reduced;

changing the pH to a different value; and repeating the method in the same or a different bed or on different particles to remove a different one or combination of metals.

2. A method of purifying an electrolyte containing cations of a less noble metal from contamination by cations of a more noble metal, said metal comprising the steps of:

upwardly levitating a bed of at least superficially electronically conductive particles with said electrolyte, said particles being more nobel than said less noble metal, a cathode current feder being provided in contact with said bed, an anode being provided in contact with and at least halfway up said bed but being of a material having a contact resistance in air between itself and a copper test surface of at least ten times the contact resistance under the same conditions of measurement between the copper test surface and another surface of copper;

applying a voltage between said cathode current feeder and said anode, the electric field being parallel to the levitation, to cause said cations to be electroplated on said particles of said bed, theless noble metal upon being electroplated redissolving with concomitant cementation of the more noble metal on the particles;

controlling the pH of the electrolyte so that substantially one metal, or one desired combination of metals, at a time is removed from it;

removing the electrolyte which has passed through said bed and in which the concentration of the nobler metal cations has thereby been reduced;

changing the pH to a different value; and repeating the method in the same or a different bed or on different particles to remove a different one or a combination of metals.

3. A method according to claim 1 or 2, wherein at least a part of said electrolyte is recycled to the bed one or more times before at least a part of the electrolyte is removed.

4. A method according to claim 1 or 2, wherein at least part of the electrolyte is recycled to the bed at least once before it is removed.

5. A method according to claim 1 or 2, wherein the more noble metal is recovered from the bed.

6. A method according to claim 1 or 2, wherein the bed is levitated to an expansion of up to 70% of its static height.

7. A method according to claim 6, wherein the bed is levitated to an expansion of 5 to 50% of its static height.

8. A method according to claim 7, wherein the bed is levitated to an expansion of 15 to 30% of its static height.

9. A method according to claim 1 or 2, wherein the applied voltage (in volts) divided by the distance (in cm) between the cathode current feeder and the top of the bed when levitated is from 1 to 10.

10. A method according to claim 1 or 2, wherein current through the bed is from 30A to 3000A per square meter of the bed.

11. A method according to claim 1 or 2, wherein the electrolyte to be purified contains zinc ions and copper ions.

12. A method according to claim 11, wherein the electrolyte to be purified contains cadmium ions.

13. A method according to claim 11, wherein the electrolyte to be purified contains cobalt ions.

14. A method according to claim 1 or 2, wherein the bed particles are of copper.

15. A method according to cliam 1 or 2, wherein the bed particles are from 0.1 to 1 mm in diameter.

16. A method according to claim 1 or 2, wherein the cathode current feeder is at least one-half of the way up the levitated bed.

17. A method according to claim 1 or 2, wherein the cathode current feeder is from 10 to 100 particle diameters down from the top of the levitated bed.

18. A method according to claim 1 or 2, wherein the cathode current feeder is from 20 to 200 particles diameters down from the top of the levitated bed.

* * * * *